US006210224B1

(12) United States Patent
Wu

(10) Patent No.: US 6,210,224 B1
(45) Date of Patent: Apr. 3, 2001

(54) ELECTRICAL CONNECTOR

(75) Inventor: Kun-Tsan Wu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/335,799

(22) Filed: Jun. 17, 1999

(30) Foreign Application Priority Data

Nov. 24, 1998 (TW) ..... 87219534

(51) Int. Cl.[7] ..... H01R 13/648
(52) U.S. Cl. ..... 439/607; 439/79
(58) Field of Search ..... 439/607, 609, 439/79, 80, 752, 70, 689, 686

(56) References Cited

U.S. PATENT DOCUMENTS 4,632,495 * 12/1986 Furman ..... 439/752
5,199,886 * 4/1993 Patterson ..... 439/79
5,273,460 * 12/1993 Arai ..... 439/609
5,281,169 * 1/1994 Kiat et al. ..... 439/607
5,288,248 * 2/1994 Chen ..... 439/609
5,637,015 * 6/1997 Tan et al. ..... 439/607
5,957,732 * 9/1999 Ito et al. ..... 439/752

* cited by examiner

*Primary Examiner*—Neil Abrams
*Assistant Examiner*—Javaid Nasri
(74) *Attorney, Agent, or Firm*—Wei Te Chung

(57) ABSTRACT

An electrical connector includes an insulative body including a first member defining channels for receiving first sections of L-shaped contact elements and a second member attached to the first member for retaining second sections of the contact elements therebetween. A shield casing made from a single metal plate defines a front opening for receiving a mating connector and a rear opening through which the insulative body is inserted into the shield casing and substantially surrounded thereby. A shield cover is attached to the shield casing to seal the rear opening thereof.

10 Claims, 5 Drawing Sheets

ELECTRICAL CONNECTOR

BACKGROUND OF THE INVENTION

1. Field of the Invention

The present invention generally relates to an electrical connector, and in particular to a connector structure which promotes efficient assembly.

2. The Prior Art

An electrical connector frequently includes a shielding member at least partially enclosing the connector for protecting the connector from external electromagnetic interference (EMI). A conventional shielding member made from a single metal plate surrounds the connector by means of bending and metal forming. However, the process for bending the metal plate to surround the connector is complicated and costly.

Furthermore, contact elements of a conventional electrical connector are mounted thereto by being inserted into channels defined in the connector in a direction substantially parallel to a mating force applied thereto when the connector is mated with a mating connector. Thus, the contact elements may become separated from the connector when mating with the mating connector.

It is thus desired to have an electrical connector that eliminates the above-discussed problems.

SUMMARY OF THE INVENTION

Accordingly, an object of the present invention is to provide an electrical connector having a structure promoting efficient assembly during mass production.

Another object of the present invention is to provide an electrical connector having contact elements securely retained therein without being readily separated therefrom.

To achieve the above objects, an electrical connector in accordance with the present invention comprises an insulative body comprising a first member defining channels for receiving first sections of L-shaped contact elements and a second member attached to the first member for retaining second sections of the contact elements therebetween. A shield casing made from a single metal plate defines a front opening for receiving a mating connector and a rear opening through which the insulative body is inserted into the shield casing and substantially surrounded thereby. A shield cover is attached to the shield casing to seal the rear opening thereof.

BRIEF DESCRIPTION OF THE DRAWINGS

The present invention will be apparent to those skilled in the art by reading the following description of a preferred embodiment thereof with reference to the accompanying drawings, in which.

DETAILED DESCRIPTION OF THE PREFERRED EMBODIMENT

Figure 1:
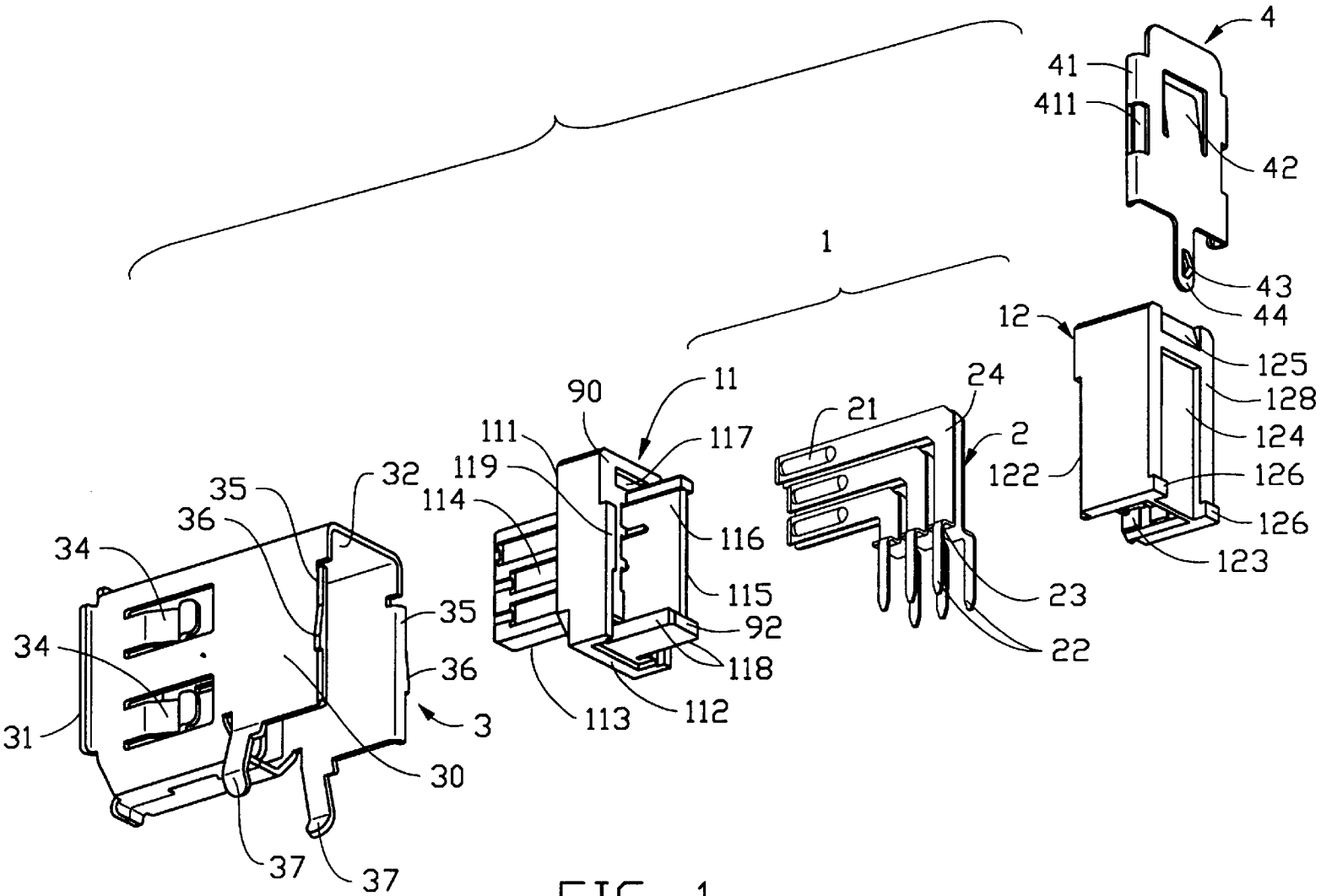
FIG. 1 is an exploded view of an electrical connector constructed in accordance with the present invention.
Figure 2:
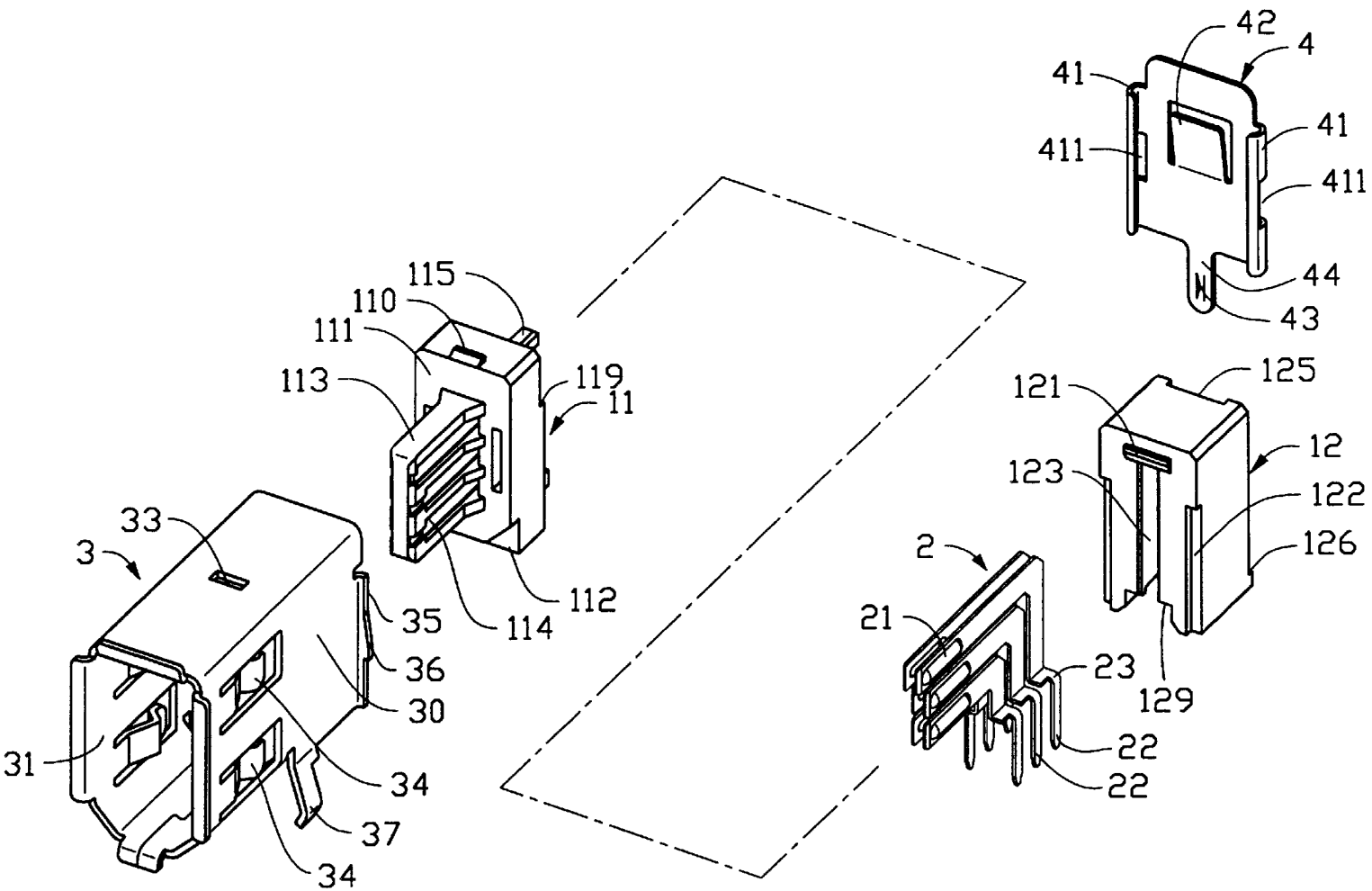
FIG. 2 is an exploded view of the electrical connector of the present invention taken from a different perspective.

Referring to the drawings and in particular to FIGS. 1 and 2, an electrical connector constructed in accordance with the present invention comprises an insulative body 1 receiving and retaining contact elements 2 therein and a shield casing 3 enclosing the insulative body 1 for protecting the contact elements 2 from electromagnetic interference (EMI). The insulative body 1 includes a contact support 11 and a contact retainer 12. The contact support 11 has a front mating face 111 from which a tongue 113 extends and an opposite rear face 90. A number of channels 114 are defined in the contact support 11 between the front and rear faces 111, 90 and exposed to two opposite surfaces (not labeled) of the tongue 113 for receiving and retaining the contact elements 2 therein.

The contact support 11 has a rear rib 115 extending from the rear face 90 thereof Recesses 116 are defined on opposite sides of the rib 115 in communication with the channels 114 for partly receiving the contact elements 2 therein. A lower flange 92 is attached to a lower edge of the rib 115 thereby forming two opposite steps 118 for supporting the contact elements 2.

The contact elements 2 are L-shaped having a first section 21 received in the channels 114 and a second section 24 substantially normal to the first section 21 and received in the recesses 116. Each second section 24 has a tail 22 connected thereto by means of an offset section 23 seated on the steps 118 whereby the tail 22 extends beyond a bottom mounting face 112 of the contact support 11. The bottom mounting face 112 is positionable on a circuit board (not shown) for allowing the tails 22 of the contact elements 2 to be properly soldered to the circuit board.

The contact retainer 12 defines a T-shaped slot 123 for receiving the rear rib 115 and the lower flange 92 therein. The T-shaped slot 123 has two opposing shoulders 129 disposed above the steps 118 of the lower flange 92 for interposing the offset sections 23 of the contact elements 2 therebetween thereby retaining the contact elements 2 in the insulative body 1.

Figure 3:
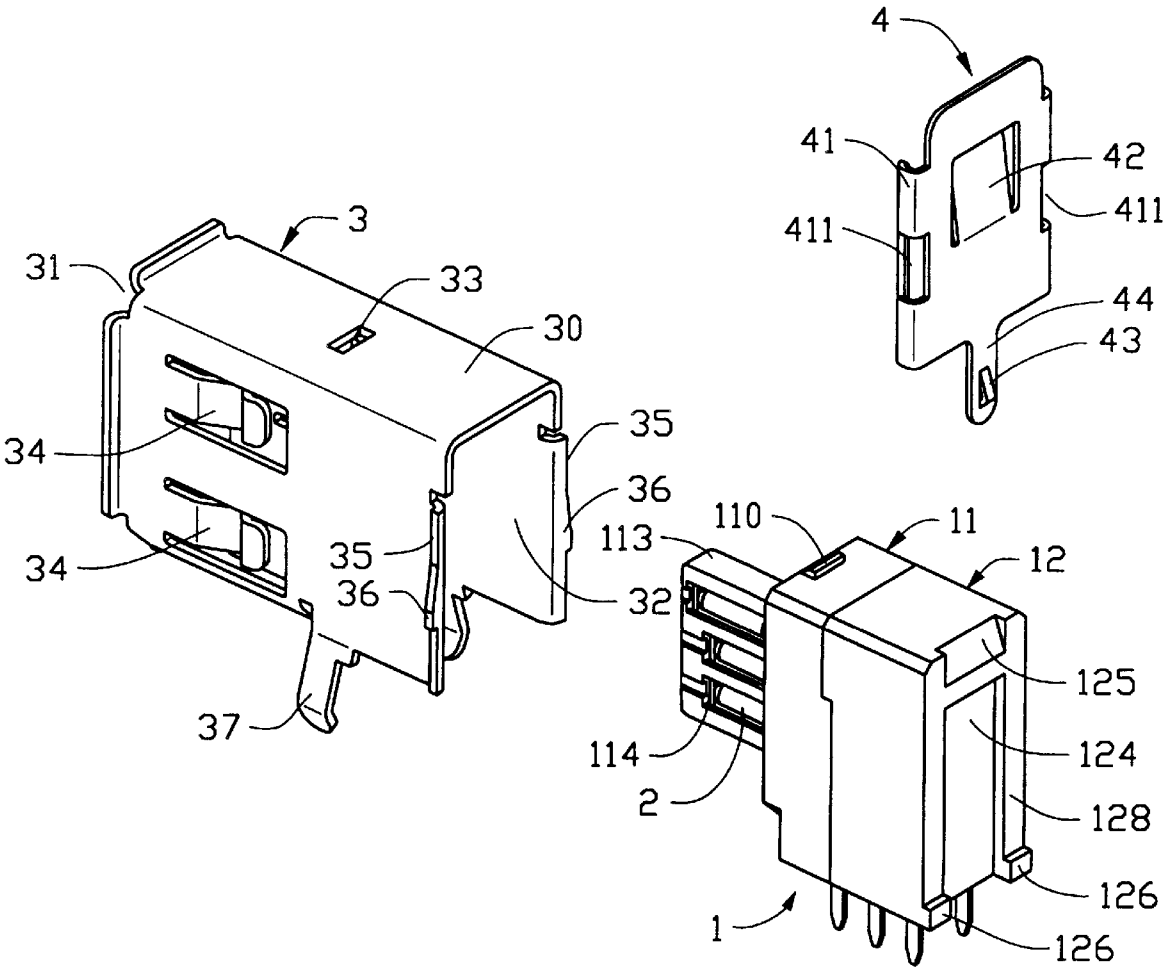
FIG. 3 is a partially assembled view of FIG. 1.
Figure 4:
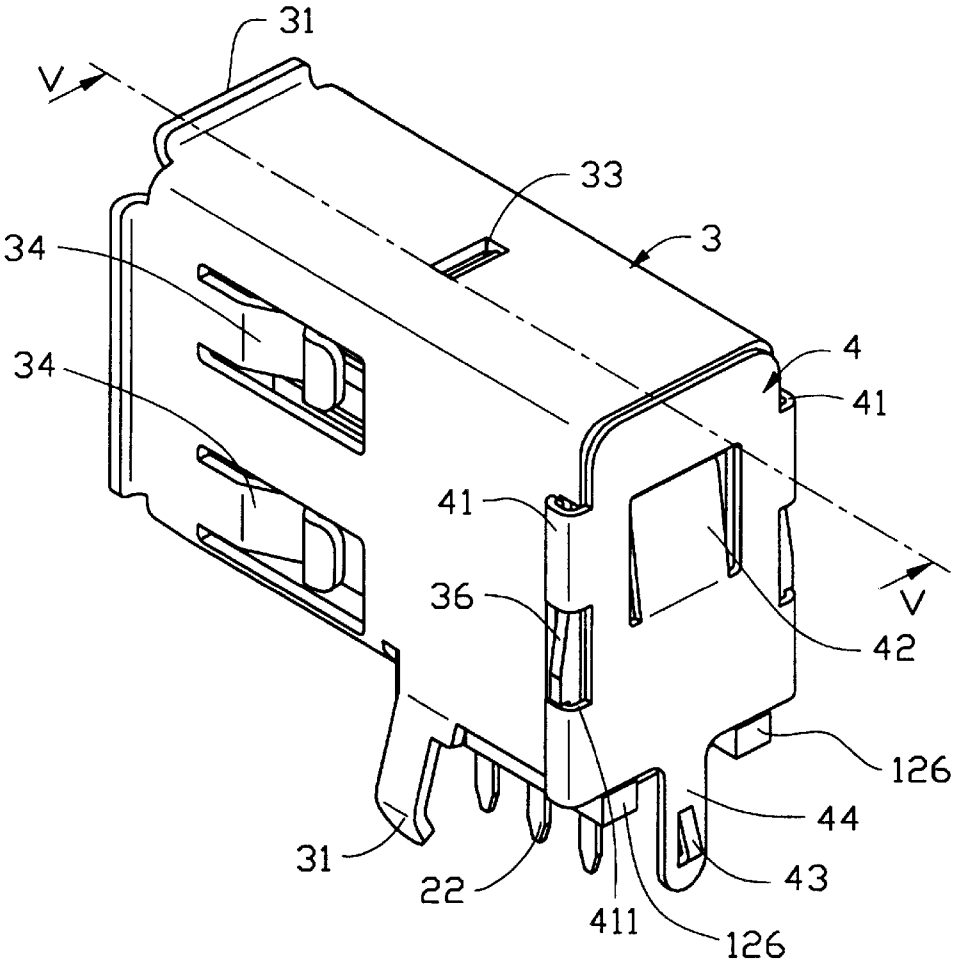
FIG. 4 is an assembled view of FIG. 3.
Figure 5:
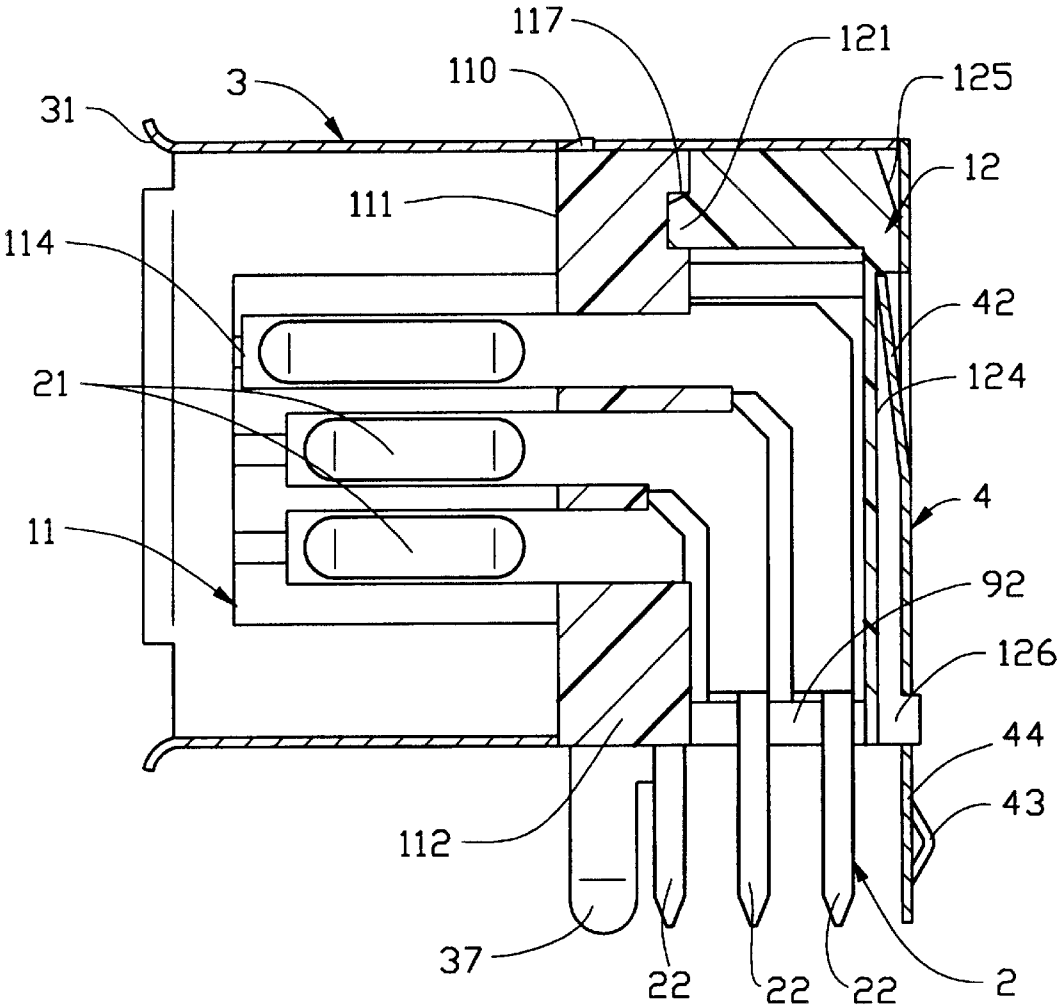
FIG. 5 is a cross-sectional view taken along line V—V of FIG. 4.

Also referring to FIGS. 3–5, the contact retainer 12 has a front projection 121 engaging with a recess 117 defined in the rear face 90 of the contact support 11 thereby securing the contact retainer 12 to the contact support 11. The contact support 11 has two flanges 119 formed on opposite edges of the rear face 90 thereof at. The contact retainer 12 forms two cutouts 122 for receiving the flanges 119 of the contact support 11 therein for properly positioning the contact retainer 12 with respect to the contact support 11 when securing the contact retainer 12 to the contact support 11.

The shield casing 3 comprises a casing body 30 made from a single metal plate by means of stamping and bending. The casing body 30 has side walls (not labeled) defining a rear opening 32 through which the insulative body 1 is slidably inserted into the casing body 30 and a front opening 31 adapted to receive a mating connector (not shown) for establishing electrical connection between the contact elements 2 and the mating connector. The casing body 30 defines at least one slot 33 therein for engaging with a projection 110 formed on the contact support 11 thereby securing the insulative body 1 in the shield casing 3. The casing body 30 also forms a number of resilient engaging arms 34 which are preferably stamped thereon and inwardly bent for resiliently engaging with and retaining the mating connector in the casing body 30. Mounting tabs 37 are also formed on the casing body 30 for mounting and grounding to the circuit board.

A shield cover 4 seals the rear opening 32 of the shield casing 3 after the insulative body I is received in the shield casing 3. The shield cover 4 has two opposite inwardly-bent edges defining two channels 41 which receive two outwardly-bent flanges 35 formed on opposite edges of the rear opening 32 of the shield casing 3 thereby securing the shield cover 4 to the shield casing 3. Each outward-bent flange 35 of the shield casing 3 has a barb 36 formed thereon for engaging with a corresponding opening 411 defined in the shield cover 4.

The insulative body 1 is received in the shield casing 3 with a rear face 128 of the contact retainer 12 substantially flush with the rear opening 32 of the shield casing 3. A recess 124 is defined in the rear face 128 of the contact retainer 12. A resilient inward projection 42 is stamped on the shield cover 4 for engaging with the recess 124 of the contact retainer 12 thereby fixing the shield cover 4 in position. An inclined slot 125 is defined in the rear face 128 of the contact retainer 12 for guiding the inward projection 42 of the shield cover 4 into the recess 124. Preferably, projections 126 are formed on the rear face 128 of the contact retainer 12 for stopping and supporting a lower edge of the shield cover 4 thereby properly positioning the shield cover 4 with respect to the shield casing 3.

The shield cover 4 has an additional grounding tab 44 extending therefrom for engaging with a corresponding hole defined in the circuit board for grounding purposes. Preferably, the grounding tab 44 has a projection 43 formed thereon for securely engaging with the hole of the circuit board.

Although the present invention has been described with reference to the preferred embodiment, it is apparent to those skilled in the art that a variety of modifications and changes may be made without departing from the scope of the present invention which is intended to be defined by the appended claims.

What is claimed is:

1. An electrical connector comprising:

an insulative contact support having a first face adapted to be positioned on a circuit board and a plurality of channels defined therein for receiving contact elements, the channels being exposed to a second face of the contact support and adapted to electrically engage with a mating connector, each contact element having a tail extending beyond the first face for electrically connecting to the circuit board; and an insulative contact retainer secured to the contact support for firmly abutting and retaining the contact elements in the channels;

wherein a tongue is formed on the second face and has opposite surfaces with the channels defined therein, each channel receiving a first section of the corresponding contact element;

wherein the contact support has a third face opposite the second face, a rib being formed on the third face having opposite surfaces, each surface defining a recess in communication with the channels for accommodating second sections of the contact elements;

wherein a lower flange is attached to a lower edge of the rib thereby forming two opposite steps, and wherein each contact element comprises an offset section connecting the tail to the second section thereof, the offset section being supported on the corresponding step of the rib.

2. The electrical connector as claimed in claim 1, wherein the contact retainer defines a T-shaped slot receiving the rib and the lower flange therein, the slot having two shoulders corresponding to the steps of the rib thereby interposing and retaining the offset sections of the contact elements therebetween.

3. The electrical connector as claimed in claim 2, wherein the contact support forms positioning projections received in corresponding cutouts defined in the contact retainer for properly positioning the contact retainer with respect to the contact support.

4. The electrical connector as claimed in claim 2, wherein one of the contact support and the contact retainer forms an engaging projection and the other one defines a recess engaged with the engaging projection for securing the contact retainer to the contact support.

5. An electrical connector comprising:

an insulative body assembly defining a number of channels therein for receiving and retaining contact elements;

a shield casing defining a front opening adapted to receive a mating connector and a rear opening through which the insulative body assembly is inserted; and a shield cover releasably attached to and in electrical connection with the shield casing for sealing the rear opening wherein the shield casing forms an outward-bent flange on each of two opposite edges of the rear opening, the shield cover defining two guide channels slidably receiving the outward-bent flanges of the shield casing thereby attaching the shield cover to the shield casing;

wherein each outward-bent flange forms a barb engaging with an opening defined in the shield cover for securing the shield cover to the shield casing.

6. The electrical connector as claimed in claim 5, wherein the insulative body assembly has a face adjacent to the rear opening of the shield casing and defines a recess therein, the shield cover forming an inward projection engaging with the recess for securing the shield cover to the insulative body assembly.

7. The electrical connector as claimed in claim 5, wherein the insulative body assembly forms at least one stop on a face thereof for stopping and supporting a lower edge of the shield cover.

8. The electrical connector as claimed in claim 5, wherein the insulative body assembly forms a projection engaging with a slot defined in the shield casing for retaining the insulative body assembly in the shield casing.

9. An electrical connector comprising:

an insulative contact support having a first face adapted to be positioned on a circuit board and a plurality of channels defined therein for receiving contact elements, the channels being exposed to a second face of the contact support and adapted to electrically engage with a mating connector, each contact element having a tail extending beyond the first face for electrically connecting to the circuit board;

an insulative contact retainer secured to the contact support for firmly abutting and retaining the contact elements in the channels;

a shield casing enclosing the contact support and the contact retainer, the shield casing defining a first opening adapted to receive a mating connector for electrically engaging with the contact elements at the second face of the contact support;

wherein the shield casing defines a second opening opposite the first opening and sealed by a shield cover;

wherein the contact retainer has a face adjacent to the second opening of the shield casing and defines a recess therein, the shield cover forming an inward projection engaging with the recess for securing the shield cover to the contact retainer.

10. The electrical connector as claimed in claim 9, wherein the contact retainer forms at least one stop on the face thereof for stopping and supporting a lower edge of the shield cover.

* * * * *